US005623915A

United States Patent [19]

Kudlacek

[11] Patent Number: 5,623,915

[45] Date of Patent: Apr. 29, 1997

[54] ARCHERY BOWSTRING SYSTEM

[76] Inventor: Donald S. Kudlacek, 3412 Oak St., Longview, Wash. 98632

[21] Appl. No.: 203,241

[22] Filed: Feb. 28, 1994

[51] Int. Cl.[6] ..... F41B 5/10

[52] U.S. Cl. ..... 124/25.6; 124/86

[58] Field of Search ..... 124/23.1, 24.1, 124/25.6, 86, 88, 900

[56] References Cited

U.S. PATENT DOCUMENTS

| | | | |
|---|---|---|---|
| 4,332,231 | 6/1982 | Napier et al. . | |
| 4,377,152 | 3/1983 | Saunders | 124/88 |
| 4,440,142 | 4/1984 | Simonds | 124/25.6 |
| 4,452,222 | 6/1984 | Quartino et al. | 124/88 X |
| 4,542,732 | 9/1985 | Troncoso . | |
| 4,733,648 | 3/1988 | Martin | 124/86 |
| 4,781,167 | 11/1988 | Martin | 124/25.6 |
| 4,903,678 | 2/1990 | Walker | 124/90 |
| 4,909,231 | 3/1990 | Larson | 124/25.6 X |
| 4,917,070 | 4/1990 | Townsend | 124/25.6 X |
| 5,178,122 | 1/1993 | Simonds | 124/25.6 |
| 5,307,787 | 5/1994 | Loborde et al. | 124/25.6 |

*Primary Examiner*—Eric K. Nicholson
*Attorney, Agent, or Firm*—Olson & Olson

[57] ABSTRACT

A compound archery bow is provided with a power cable system in which two pairs of parallel, laterally spaced power cable stretch segments extend parallel to and symmetrical with respect to the operating plane of a bowstring extending between eccentric cams mounted on the outer ends of bow limbs by cam shafts. One end of each of the parallel power cable stretch segments of each pair is connected to a single cable end segment. The free end of each end segment is secured to a different one of the eccentric cams and the free ends of the associated pair of stretch segments are connected to spaced apart positions on the shaft that mounts the cam opposite the cam to which the associated single cable end segment is secured. The stretch segments are held in spaced apart arrangement either by a spreader pin adjacent each of the opposite ends of the stretch segments, or by a pair of elongated cable guard rods projecting rearwardly from the bow handle and spaced apart to opposite lateral sides of the operating plane of the bowstring.

16 Claims, 3 Drawing Sheets

ARCHERY BOWSTRING SYSTEM

BACKGROUND OF THE INVENTION

This invention relates to archery bows, and more particularly to a compound archery bowstring system in which the power cables are arranged to extend across the central, handle portion of the bow, spaced apart laterally to receive an arrow between them.

It is conventional practice with compound archery bows to extend each power cable from a .different one of the end cams across the bow to an anchor on the pivot shaft of the opposite cam. These power cables thus extend across the bow closely adjacent the arrow bowstring. In order to provide adequate room for the arrow, it is conventional practice to mount a cable guard on the bow to engage the central portions of the power cables and to displace them laterally a sufficient distance to one side of the operating plane of the bowstring to avoid interference with an arrow. By offsetting the central portions of the power cables from the plane of the bowstring, movement of the power cables during operation of the bow in projecting an arrow, creates off-center torque which not only decreases the accuracy of arrow flight, but also causes twisting of the limbs and handle and thereby contributes adversely to shortening their useful life.

SUMMARY OF THE INVENTION

This invention provides a compound archery bowstring system in which each power cable has a portion formed of two cables, and means is provided for engaging said two cables and spreading them apart to opposite sides of the operating plane of the bowstring.

It is the principal objective of this invention to provide a compound archery bow with a power cable system that eliminates off-center torque and twisting of the limbs and handle.

Another objective of this invention is the provision of a compound archery bow with a power cable system that increases accuracy of arrow flight by elimination of off-center torque.

Still another objective of this invention is to provide a compound archery bow with a power cable system that increases the speed of arrow flight by reducing or eliminating the friction ordinarily incurred by use of the cable guards of the prior art.

A further objective of this invention is the provision of a compound archery bow with a power cable system that reduces the total weight of the archery bow by eliminating the cable guard.

A still further objective of this invention is to provide a compound archery bow with a power cable system that reduces the hazard of use of the bow by eliminating the cable guard.

A further objective of this invention is the provision of a power cable assembly of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 1:
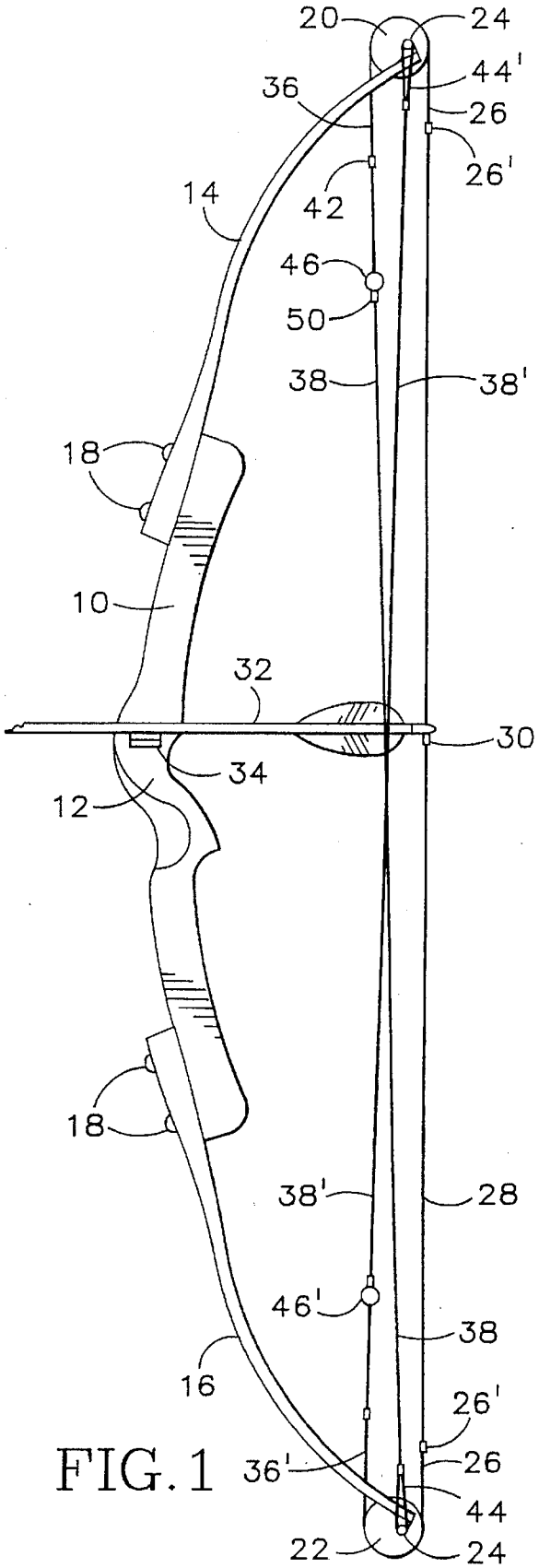
FIG. 1 is a side elevational view of a compound archery bow provided with a power cable system embodying the features of this invention.

Referring to the embodiment of FIGS. 1–4, a typical compound archery bow includes a handle 10 with hand grip 12. The opposite ends of the handle mount flexible limbs 14 and 16, as by adjustment screws 18. The outer ends of the limbs mount eccentric cams 20 and 22 by mounting shafts 24. Secured to each cam is a bowstring end segment 26, and these end segments detachably connect the opposite ends of a bowstring 28 as by couplers 26'. The bowstring is provided with a nock 30 for locating the slotted nock end of an arrow 32. An arrow rest 34 is provided on the bow handle, in conventional manner.

Each cam also secures one end of a power cable which extends across the bow and is secured at that end to one end of the associated cam mounting shaft 24. When both power cables are installed, they are so close to the operating plane of the bowstring 28 that a cable guard is employed to displace the power cables laterally to one side of the operating plane of the bowstring a distance sufficient to prevent interference with the flight of an arrow from the bowstring. It is this lateral offsetting of the power cables that produced off-center torque and the adverse effects thereof.

In accordance with this invention, two identical power cables are provided. Since they are identical, only one is described in detail hereinafter, and the other power cable is shown in the drawings with the same reference numerals but distinguished by a superscript. Thus, each power cable is constructed to provide a short end segment 36 for attachment at one end to its associated cam and at the other end to a pair of stretch segments 38 and 40 extending from the wrap 42. The free ends of the stretch segments are provided with loops 44 for connection one to each projecting end of a cam shaft 24 that mounts the cam on the limb opposite the cam to which the short end segment 36 is attached.

A preferred construction of the power cable is to provide one full length cable of, for example, 40 strands and divide it in two at the wrap 42 to form the stretch segments 38 and 40 of 20 strands each. The wrap 42 secures the end segment 36 against separation into the two stretch segments. The effect is the formation of a short end segment and a pair of longer stretch segments.

It is to be observed that when a power cable of this invention is attached at the short end segment 36 to a cam and the free ends of the two long stretch segments are attached to the opposite ends of the cam shaft at the opposite end of the bow, the stretch segments diverge from the splice wrap 42 to their free ends, closely adjacent but on opposite lateral sides of the operating plane of the bowstring 28. Since the stretch segments are too close to the plane of the bowstring, particularly in the central area where an arrow 32 is located, means is provided for spacing the stretch segments farther apart laterally and hence laterally farther from the operating plane of the bowstring.

In FIGS. 1–4 the stretch segments 38 and 40 are moved farther apart laterally by means of a spreader pin 46. Each pin is provided on its longitudinal ends with slots 48 dimensioned to receive the stretch segments and thereby spread the latter apart a desired distance selected by the length of the spreader pins. Abutment wraps 50 of bowstring serve to prevent the spreader pin from moving inward along the stretch segments.

Figure 2:
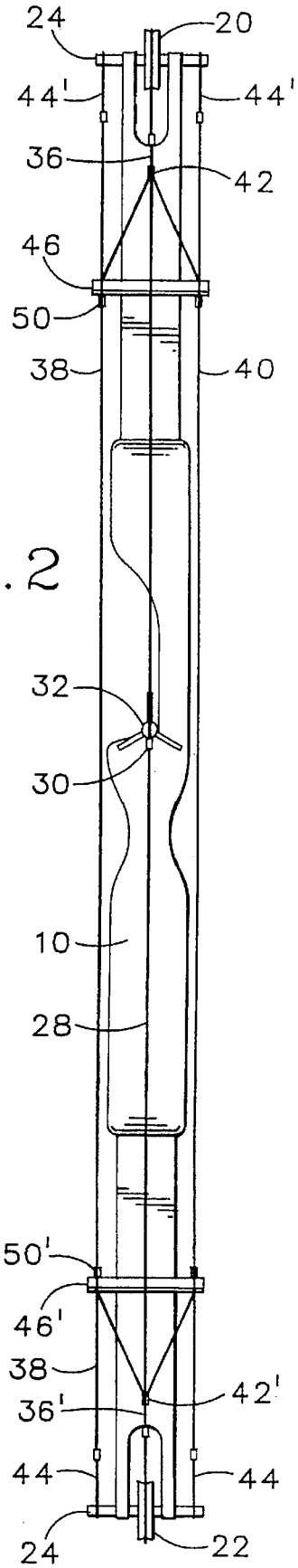
FIG. 2 is a rear elevation as viewed from the right in FIG. 1.
Figure 3:
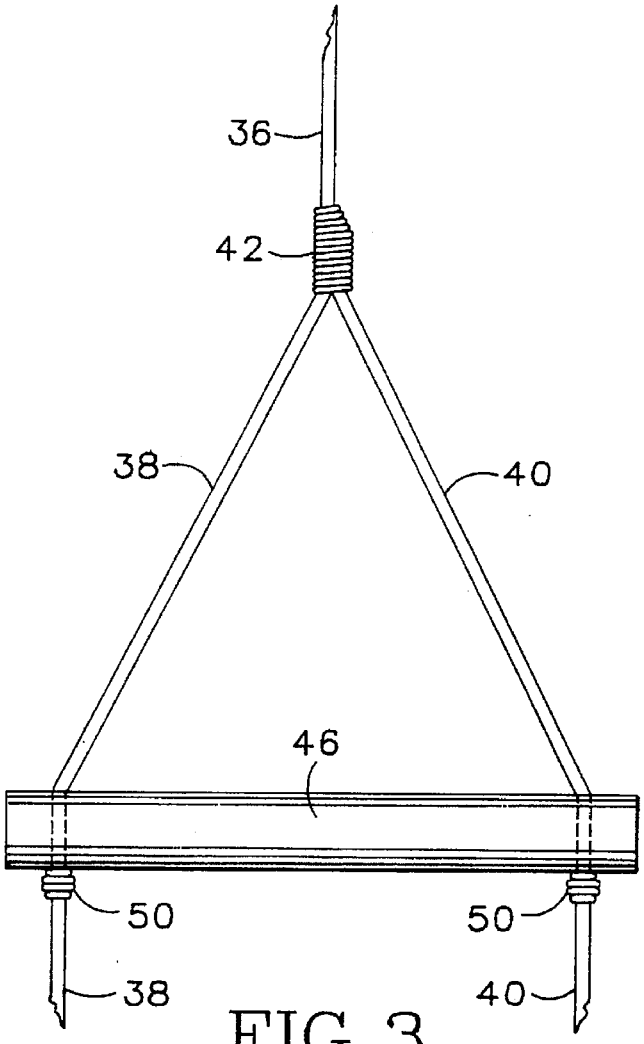
FIG. 3 is a fragmentary rear elevational view, on an enlarged scale, of the upper spreader pin arrangement of FIG. 2.
Figure 4:
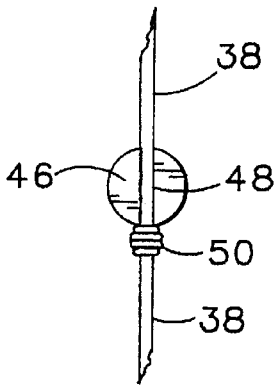
FIG. 4 is a fragmentary side elevation, on an enlarged scale, as viewed from either side of FIG. 3.

As best shown in FIG. 2, with the spreader pins installed at both ends of the stretch segments, the latter extend endwise across the bow parallel to the plane of the bowstring 28 and at equal distances on opposite lateral sides of the operating plane of the bowstring, sufficient to afford ample room for movement of the arrow during flight. Moreover, since the end segments and stretch segments are disposed symmetrically with respect to the plane of the bowstring, the power cable system is also symmetrical with respect to the limbs. Accordingly, no off-center torque is created during operation of the bow, thereby maximizing the accuracy of the arrow flight and operating life of the limbs and handle.

Figure 5:
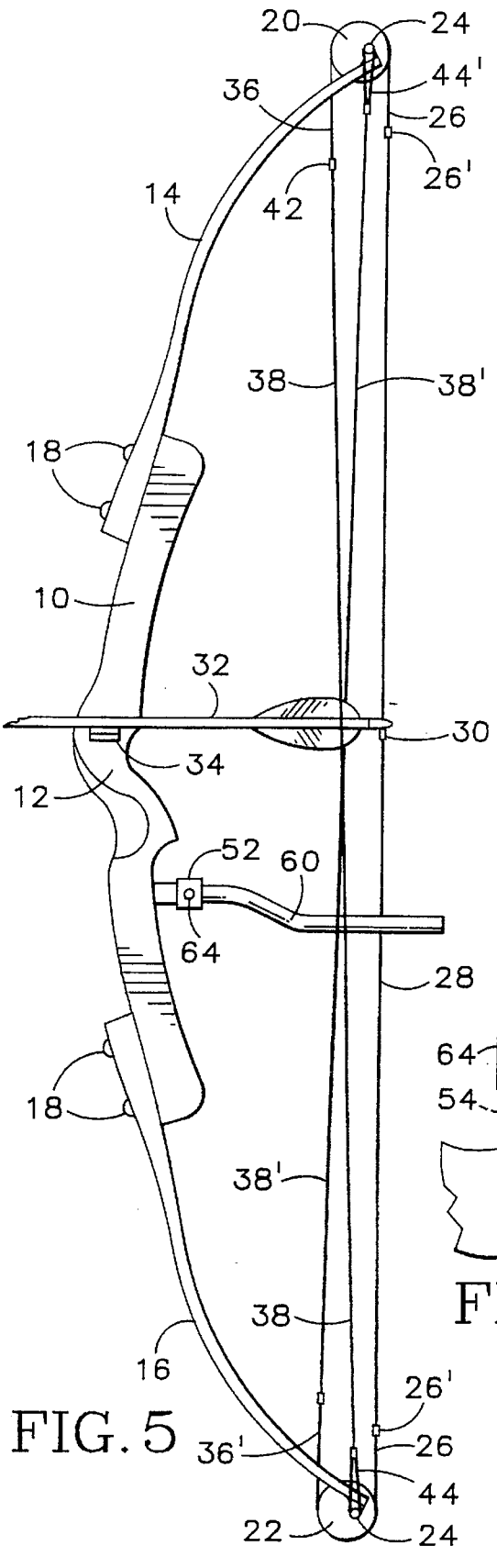
FIG. 5 is a side elevational view of a compound archery bow provided with a second form of power cable system embodying the features of this invention.
Figure 7:
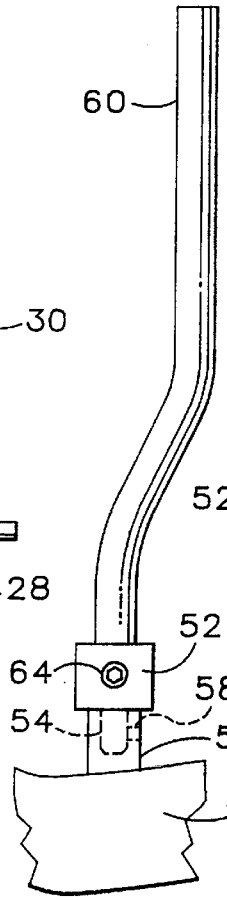
FIG. 7 is a fragmentary side elevation, on an enlarged scale, as viewed from the left in FIG. 6.
Figure 6:
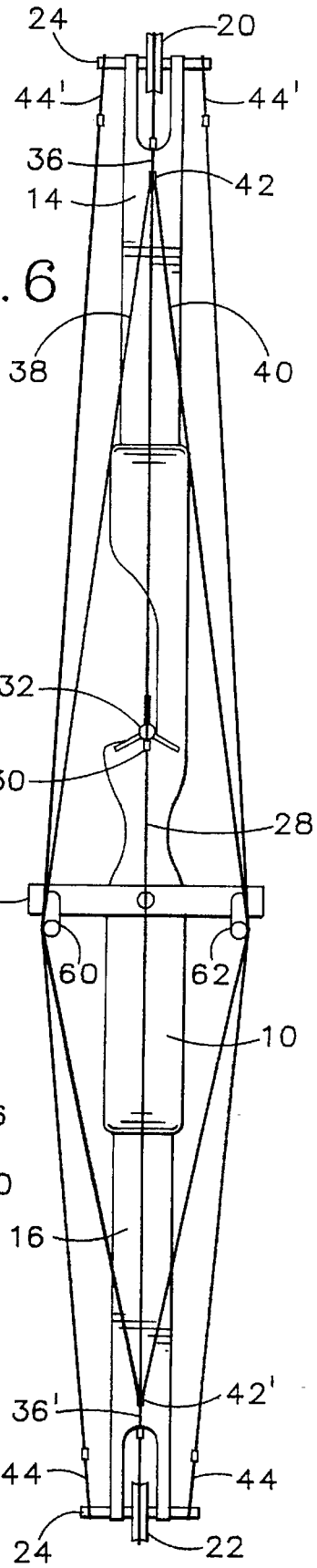
FIG. 6 is a rear elevation as viewed from the right in FIG. 5.

FIGS. 5–7 of the drawings illustrate a second form of means for spreading the power cable stretch segments 38 and 40 apart to opposite lateral sides of the operating plane of the bowstring. In this embodiment an elongated dual cable guard base member 52 is provided with a central mounting shaft 54 configured for removable reception in a bore in a support post 56 on the bow handle 10. A setscrew 58 removably secures the shaft 54 to the post in any desired position of rotation of the base member 52.

A pair of elongated cable guard rods 60 and 62 are mounted removably and rotationally in bores adjacent the opposite ends of the elongated base member 52, and are secured releasably therein by setscrews 64.

As best shown in FIG. 6 of the drawings, the rearwardly extending dual cable guards 60 and 62 are spaced apart laterally to opposite lateral sides of the operating plane of the bowstring. The power cable stretch segments 38 and 40 abut the outer sides of the cable guards and thus are spaced apart laterally to opposite sides of the operating plane of the bowstring a distance which affords ample room for unrestricted movement of an arrow 32 during flight.

As in the embodiment of FIGS. 1–4, the power cable system of FIGS. 5–7 is disposed symmetrically with respect to the operating plane of the bowstring 28 and with respect to the bow limbs, to eliminate off-centered torque during operation of the bow.

The spreader pins of FIGS. 1–4 and the dual cable guard of FIGS. 5–7 both are effective in displacing the stretch segments 38 and 40 desired distances to opposite lateral sides of the operating plane of the bowstring 28. The use of the spreader pins affords the advantages of reducing overall weight of the archery bow assembly and of eliminating the potential hazard always posed by the use of cable guards, in the event of breakage of a bow limb or handle.

it will be apparent to those skilled in the art that various changes may be made in the size, shape, type, number and arrangement of parts described hereinbefore, without departing from the spirit of this invention and the scope of the appended claims.

I claim:

1. In combination with a compound archery bow having eccentric cams at the outer ends of limbs extending from a central bow handle, and an intermediate arrow position, a bowstring system comprising:

a) a pair of power cables each having a single cable end segment having a free end and a pair of stretch segments having free ends secured at one end to one end of the end segment, b) the free end of the end segment of each power cable being arranged for connection to a different one of the eccentric cams of a compound archery bow and the free ends of the pair of stretch segments of each power cable being arranged for connection to laterally spaced positions on the limb of the compound archery bow mounting the eccentric cam opposite the cam connecting the end segment, whereby the pair of stretch segments of each power cable extends across the intermediate, arrow position of the archery bow, c) spacer means for engaging the pair of stretch segments of each power cable for spreading said segments apart to opposite sides of the operating plane of a bowstring, for receiving an archery arrow between the spaced stretch segments of each of said power cables, and d) a bowstring connected to and extending between said eccentric cams for operation in a plane disposed between the spread stretch segments of the power cables.

2. The archery bowstring system of claim 1 wherein each power cable comprises a length of multi-strand cable having a predetermined number of strands, a portion of said cable being separated into two stretch segments each having one-half the totally of said predetermined number of strands, and securing means at the juncture of the end segment and stretch segments for preventing separation of the end segment into the two stretch segments.

3. The archery bowstring system of claim 1 wherein the spacer means comprises a spreader pin for engaging and extending between the pair of stretch segments of each of the pair of power cables adjacent the single cable end segment.

4. The archery bowstring system of claim 3 wherein each spreader pin has a slot in each of its longitudinal ends configured to receive a stretch segment therein.

5. The archery bowstring system of claim 3 including abutment means on the stretch segments of each power cable arranged for abutment by the spreader pin.

6. The archery bowstring system of claim 1 wherein the spacer means comprises a dual cable guard arranged for mounting on the handle of a compound archery bow and configured to engage and spread apart laterally the stretch segments of the pair of power cables to opposite sides of the operating plane of a bowstring.

7. The archery bowstring system of claim 6 wherein the dual cable guard has a base member arranged to be mounted removably on the handle of a compound archery bow, and a pair of elongated cable guard rods spaced apart on the base member and arranged to engage and spread apart the stretch segments of a pair of power cables.

8. In combination with a compound archery bow having spaced eccentric cams at the outer ends of limbs extending from a central bow handle, and an intermediate arrow position, a bowstring system comprising:

a) a bowstring connected to and extending between said spaced eccentric cams of the compound archery bow, the bowstring being movable in an operating plane during projection of an arrow therefrom, b) a pair of power cables each having a single cable end segment having a free end and a pair of stretch segments having free ends secured at one end to one end of the end segment, c) the free end of the end segment of each power cable being connected to a different one of the eccentric cams and the free ends of the pair of stretch segments of each power cable being connected to laterally spaced positions on the limb mounting the eccentric cam opposite the cam connecting the end segment, whereby the pair of stretch segments of each power cable extends across the intermediate, arrow position of the archery bow, and d) spacer means for engaging the pair of stretch segments of each power cable for spreading said segments apart to opposite sides of the operating plane of the bowstring, for receiving an archery arrow between the spaced stretch segments of each of said power cables.

9. The combination of claim 8 wherein each power cable comprises a length of multi-strand cable having a predetermined number of strands, a portion of said cable being separated into two stretch segments each having one-half the total of said predetermined number of strands, and securing means at the juncture of the end segment and stretch segments for preventing separation of the end segment into the two stretch segments.

10. The combination of claim 8 wherein the spacer means comprises a spreader pin engaging and extending between the pair of stretch segments of each of the pair of power cables adjacent the single cable end segment.

11. The combination of claim 10 wherein each spreader pin has a slot in each of its longitudinal ends configured to receive a stretch segment therein.

12. The combination of claim 10 including abutment means on the stretch segments of each power cable arranged for abutment by the spreader pin.

13. The combination of claim 8 wherein the spacer means comprises a dual cable guard mounted on the handle of the compound archery bow and configured to engage and spread apart laterally the stretch segments of the pair of power cables to opposite sides of the operating plane of the bowstring.

14. The combination of claim 13 wherein the dual cable guard has a base member mounted removably on the handle of the compound archery bow, and a pair of elongated cable guard rods spaced apart on the base member and engaging and spreading apart the stretch segments of the pair of power cables.

15. In combination with a compound archery bow having first and second eccentric cams mounted at the outer ends of limbs extending from a central bow handle, and a central arrow position portion, a bowstring system comprising:

a) a first power cable arranged for connection at one end to said first eccentric cam of the compound archery bow and arranged for connection at the opposite end to the limb of the compound archery bow mounting said second eccentric cam, b) a second power cable arranged for connection at one end to said second eccentric cam of the compound archery bow and arranged for connection at the opposite end to the limb of the compound archery bow mounting said first eccentric cam, c) each of the first and second power cables having a pair of stretch segments arranged to extend across the central, arrow position portion of the compound archery bow, d) spacer means for engaging the pair of stretch segments of the first and second power cables for spreading said segments apart, for positioning an arrow between them, and e) a bowstring configured to be connected to and extend between said first and second eccentric cams for operation in a plane disposed between the spread stretch segments of the power cables.

16. In combination with a compound archery bow having first and second eccentric cams mounted at the outer ends of limbs extending from a central bow handle, a bowstring system comprising:

a) a bowstring secured to and extending between the spaced eccentric cams of the compound archery bow, the bowstring being movable in an operating plane during projection of an arrow therefrom, b) a first power cable connected at one end to said first eccentric cam and connected at the opposite end to the limb mounting said second eccentric cam, c) a second power cable connected at one end to said second eccentric cam and connected at the opposite end to the limb mounting said first eccentric cam, d) each of the first and second power cables having a pair of stretch segments extending across the central, arrow position portion of the compound archery bow, and e) spacer means engaging the pair of stretch segments of the first and second power cables for spreading said segments apart to opposite lateral sides of the operating plane of the bowstring.

* * * * *